US011807832B2

(12) United States Patent
Hozumi

(10) Patent No.: US 11,807,832 B2
(45) Date of Patent: Nov. 7, 2023

(54) LIQUID DETERGENT COMPOSITION FOR TABLEWARE AND/OR KITCHEN HARD ARTICLES

(71) Applicant: Kao Corporation, Tokyo (JP)

(72) Inventor: Kenji Hozumi, Wakayama (JP)

(73) Assignee: KAO CORPORATION, Tokyo (JP)

( * ) Notice: Subject to any disclaimer, the term of this patent is extended or adjusted under 35 U.S.C. 154(b) by 619 days.

(21) Appl. No.: 17/052,268

(22) PCT Filed: Jun. 3, 2019

(86) PCT No.: PCT/JP2019/021981
§ 371 (c)(1),
(2) Date: Nov. 2, 2020

(87) PCT Pub. No.: WO2019/235424
PCT Pub. Date: Dec. 12, 2019

(65) Prior Publication Data

US 2021/0087503 A1 Mar. 25, 2021

(30) Foreign Application Priority Data

Jun. 5, 2018 (JP) ..... 2018-107899

(51) Int. Cl.

| | |
|---|---|
| ***C11D 1/66*** | (2006.01) |
| ***C11D 11/00*** | (2006.01) |
| ***C11D 1/12*** | (2006.01) |
| ***C11D 1/72*** | (2006.01) |
| ***C11D 3/18*** | (2006.01) |
| ***C11D 3/20*** | (2006.01) |
| ***C11D 3/22*** | (2006.01) |
| ***C11D 17/00*** | (2006.01) |

(52) U.S. Cl.
CPC ..... *C11D 11/0035* (2013.01); *C11D 1/123* (2013.01); *C11D 1/72* (2013.01); *C11D 3/181* (2013.01); *C11D 3/201* (2013.01); *C11D 3/2044* (2013.01); *C11D 3/222* (2013.01); *C11D 11/0058* (2013.01); *C11D 17/0008* (2013.01)

(58) Field of Classification Search
CPC ..... C11D 1/66
USPC ..... 510/535
See application file for complete search history.

(56) References Cited

U.S. PATENT DOCUMENTS

| | | | |
|---|---|---|---|
| 2,028,091 | A | 1/1936 | Jaeger et al. |
| 4,434,091 | A | 2/1984 | Cox et al. |
| 2005/0003989 | A1 | 1/2005 | Noguchi et al. |
| 2008/0132439 | A1 | 6/2008 | Itoi et al. |
| 2013/0209527 | A1 | 8/2013 | Del Gaudio et al. |

FOREIGN PATENT DOCUMENTS

| | | | | |
|---|---|---|---|---|
| CN | 1550544 | A | | 12/2004 |
| CN | 1621504 | A | | 6/2005 |
| CN | 101443436 | A | | 5/2009 |
| CN | 104017668 | A | | 9/2014 |
| CN | 104762143 | A | * | 7/2015 |
| EP | 1 849 856 | A1 | | 10/2007 |
| JP | 58-24555 | A | | 2/1983 |
| JP | 8-108102 | A | | 4/1996 |
| JP | 8-332422 | A | | 12/1996 |
| JP | 11-12596 | A | | 1/1999 |
| JP | 2002-68265 | A | | 3/2002 |
| JP | 2002-294281 | A | | 10/2002 |
| JP | 2002-294300 | A | | 10/2002 |
| JP | 2005-80450 | A | | 3/2005 |
| JP | 2007-39627 | A | | 2/2007 |
| JP | 2007-153956 | A | | 6/2007 |
| JP | 2008-45108 | A | | 2/2008 |
| JP | 2008-111140 | A | | 5/2008 |
| JP | 2011-231311 | A | | 11/2011 |
| JP | 2013-82847 | A | | 5/2013 |
| JP | 2016-199754 | A | | 12/2016 |
| JP | 2017-2137 | A | | 1/2017 |

OTHER PUBLICATIONS

English translation of the International Preliminary Report on Patentability and the Written Opinion of the International Searching Authority for Internatlonal Application No. PCT/JP2019/021981, dated Dec. 17, 2020.
Hayano, "A Trail to Elucidate the Structure of Griffin's HLB-System," The Institute of Industrial Science, The University of Tokyo, Yu-Kagaku, vol. 13, No. 4, Apr. 1964, pp. 36-39.
Machine translation of JP-11-12596-A, published on Jan. 19, 1999.
Machine translation of JP-2007-153956-A, published on Jun. 21, 2007.
Machine translation of JP-2013-82847-A, published on May 9, 2013.
Machine translation of JP-2017-2137-A, published on Jan. 5, 2017.
Nishi et al., "Kaimenkasseizai-binran," Sangyo Tosho Publishing Co., Ltd., fifth printing, Jan. 10, 1966, p. 319.
(Continued)

*Primary Examiner* — Gregory E Webb
(74) *Attorney, Agent, or Firm* — Birch, Stewart, Kolasch & Birch, LLP

(57) ABSTRACT

The present invention is a liquid detergent composition for tableware and/or kitchen hard articles containing: (a) a nonionic surfactant with an HLB of 10.5 or less (provided that (b) is excluded); (b) a glycoside having a hydrocarbon group with 8 or more and 18 or less carbons and a glycoside group with an average degree of condensation of 0.5 or more and 3 or less; and (c) an organic solvent with a logPow of 0 or more and 1.5 or less [hereinafter, referred to as component (c)], wherein the content of (a) in all surfactants is 30 mass % or more and 95 mass % or less, a mass ratio of component (c) to the content of (a), (c)/(a), is 2 or more and 8 or less, and a viscosity at 20° C. is 20 mPa·s or less.

10 Claims, No Drawings

(56) References Cited

OTHER PUBLICATIONS

Japanese Office Action for Japanese Appication No. 2019-103533, dated Dec. 13, 2022.
International Search Report, issued in PCT/JP2019/021981, dated Aug. 27, 2019.
Chinese Office Action and Search Report for corresponding Chinese Application No. 201980033616.X, dated May 17, 2021, with English translation of the Office Action.

* cited by examiner

LIQUID DETERGENT COMPOSITION FOR TABLEWARE AND/OR KITCHEN HARD ARTICLES

FIELD OF THE INVENTION

The present invention relates to a liquid detergent composition for tableware and/or kitchen hard articles and a method for washing tableware and/or kitchen hard articles.

BACKGROUND OF THE INVENTION

For washing tableware or a cooking utensil, generally performed is a method including impregnating a sponge absorbing water or the like with a detergent for tableware, foaming while rubbing it several times, and washing by scrubbing the object with it. While this method had been considered to be a process necessary for removing a stubborn stain such as an oil and fat stain derived from food or the like, it had been inconvenient for washing a container or utensil with a small gap or depth not accessible by the sponge. In order to solve such an inconvenience, there has been developed a technology that enables high detergency by allowing a detergent for tableware to be adhered to the object in a foamy state, and only rinsing without having to scrub after leaving it for a certain time. That is, instead of the conventional method of washing by scrubbing with the sponge, the method of spraying in a foamy state, leaving, and washing without scrubbing has been proposed.

JP-A 2016-199754 proposes a washing method including, after bringing into contact with a hard surface, leaving a liquid detergent composition containing a sulfosuccinate alkyl ester without applying a mechanical force.

On the other hand, as to a technology of applying an alkyl glyceryl ether and an alkyl glycoside to a detergent for hard surfaces, reference can be made to JP-A 2005-60450 and JP-A 2007-39627.

SUMMARY OF THE INVENTION

The stain including a liquid oil (hereinafter, sometimes also referred to as liquid oil stain) which is adhered to, among tableware and/or kitchen hard articles, products made of plastic, for example, products made of a hydrophobic plastic such as polypropylene, polyethylene or the like, is a hard-to-remove stain.

The present invention provides a liquid detergent composition for tableware and/or kitchen hard articles excellent in detergency against the stain including a liquid oil adhered to the tableware or the like and formulation stability of the composition.

The present invention relates to a liquid detergent composition for tableware and/or kitchen hard articles containing:

(a) a nonionic surfactant with an HLB of 10.5 or less (provided that (b) is excluded) [hereinafter, referred to as component (a)]; (b) a glycoside having a hydrocarbon group with 8 or more and 18 or less carbons and a glycoside group with an average degree of condensation of 0.5 or more and 3 or less [hereinafter, referred to as component (b)]; and (c) an organic solvent with a logPow of 0 or more and 1.5 or less [hereinafter, referred to as component (c)], wherein the content of component (a) in all surfactants is 30 mass % or more and 95 mass % or less, a mass ratio of the content of component (c) to the content of component (a), (c)/(a), is 2 or more and 8 or less, and a viscosity at 20° C. is 20 mPa·s or less.

In addition, the present invention relates to a method for washing tableware and/or kitchen hard articles including bringing the liquid detergent composition for tableware and/or kitchen hard articles of the present invention into contact, in a state of foam, with the tableware and/or kitchen hard articles to which the stain containing a liquid oil derived from food is adhered.

The present invention provides a liquid detergent composition for tableware and/or kitchen hard articles excellent in detergency against the stain including a liquid oil adhered to the tableware or the like and formulation stability of the composition. The liquid detergent composition of the present invention can favorably and in a simple manner wash out the liquid oil stain adhered to articles made of a hydrophobic material such as plastic or the like.

EMBODIMENTS OF THE INVENTION

<Liquid Detergent Composition for Tableware and/or Kitchen Hard Articles>

[Component (a)]

Component (a) is a nonionic surfactant with an HLB of 10.5 or less (provided that component (b) is excluded).

The HLB of component (a) is preferably 3 or more, more preferably 4 or more and further preferably 5 or more, and preferably 10 or less, more preferably 9.5 or less and further preferably 9 or less from the viewpoint of the detergency against the liquid oil stain.

The HLB of component (a) is an HLB determined by Griffin's method and the HLB value of this method is determined by the following formula in the case of a polyoxyalkylene-type nonionic surfactant:

$$HLB \text{ value} = 20 \times (M_H/M)$$ [$M_H$: molecular weight of hydrophilic group moiety, $M$: molecular weight].

When the hydrophilic group moiety, i.e., the oxyalkylene group of the polyoxyalkylene group, has a distribution in the number of added moles, the molecular weight of the hydrophilic group moiety is determined using a mean value of the numbers of added moles.

In addition, in the case of an ester-type nonionic surfactant, it is determined by the following formula:

$$HLB \text{ value} = 20 \times (1 - S/A)$$ [$S$: saponification value of ester, $A$: acid value of fatty acid].

As to these HLB calculations, reference can be made to a method described in "Yu-kagaku, volume 13, number 4" (1964), pages 36-39, Shigeo HAYANO, Institute of Industrial Science, The University of Tokyo.

Note that, for a nonionic surfactant for which the HLB cannot be determined by Griffin's method, a value determined by experiment is adopted as the HLB. A method described in "Kaimenkasseizai-binran," published from Sangyo Tosho Publishing Co., Ltd., edited by Ichiro NISHI et al., fifth edition on Jan. 10, 1965, page 319 is adopted as the experimental method.

That is, component (a) is a nonionic surfactant for which at least one of the HLB determined by Griffin's method and the one determined by the experimental method is 10.5 or less. Hereinafter, when an HLB of a nonionic surfactant is mentioned, it refers to an HLB determined by any of the aforementioned two methods unless otherwise stated.

Examples of component (a) include one or more nonionic surfactants selected from:

(a1) alkyl glyceryl ethers with an HLB of 10.5 or less in which the number of carbons of the alkyl group is 5 or more and 10 or less [hereinafter, referred to as component (a1)];

(a2) polyoxyalkylene-type nonionic surfactants with an HLB of 10.5 or less, which are nonionic surfactants in which, on average, 1 or more and 5 or less moles of an alkylene oxide with 2 or 3 carbons is added to an aliphatic alcohol with 8 or more and 18 or less carbons or to a lower alcohol ester of a fatty acid with 8 or more and 18 or less carbons (the number of carbons of the lower alcohol is 1 or more and 3 or less) [hereinafter, referred to as component (a2)];

(a3) polyhydric alcohol ester-type nonionic surfactants consisting of an ester with an HLB of 10.5 or less, wherein the ester is of a polyhydric alcohol having 2 or more and 10 or less hydroxy groups and a fatty acid with 8 or more and 18 or less carbons [hereinafter, referred to as component (a3)];

(a4) alkanol amide-type nonionic surfactants with an HLB of 10.5 or less, which are a mono- or di-alkanol amide having an alkanoyl group with 8 or more and 18 or less carbons (the number of carbons of the alkanol group is 2 or 3), or an alkylene oxide adduct thereof (the number of carbons of the alkylene oxide is 2 or 3 and the average number of added moles thereof is more than 0 and 4 or less) [hereinafter, referred to as component (a4)]; and (a5) nonionic surfactants with an HLB of 10.5 or less, which are an adduct of an alkylene oxide with 2 or 3 carbons to an amine having a hydrocarbon group with 8 or more and 18 or less carbons [hereinafter, referred to as component (a5)].

The alkyl group constituting component (a1) may be of a linear chain or a branched chain. The alkyl group has preferably 6 or more and preferably 9 or less carbons. Specific examples of component (a1) include decyl glyceryl ether, hexyl glyceryl ether, octyl glyceryl ether and 2-ethylhexyl glyceryl ether.

The aliphatic alcohol or fatty acid constituting component (a2) may be of a linear chain or a branched chain. The aliphatic alcohol or fatty acid each has preferably 10 or more, and preferably 16 or less and more preferably 14 or less carbons. The average number of added moles of the polyoxyalkylene group of component (a2) is preferably 2 or more and preferably 4 or less. The alkylene oxide is preferably an alkylene oxide with 2 carbons and/or an alkylene oxide with 3 carbons, i.e., an ethylene oxide and/or a propylene oxide, and more preferably an ethylene oxide. As the lower alcohol ester of the fatty acid, a methyl ester and an ethyl ester are preferable. Specific examples of component (a2) include polyoxyethylene alkyl ether-type nonionic surfactants in which, on average, 1 or more and 4 or less moles of an ethylene oxide is added to a linear aliphatic alcohol with 10 or more and 14 or less carbons, polyoxyethylene alkyl ether-type nonionic surfactants in which, on average, 1 or more and 4 or less moles of an ethylene oxide is added to a secondary alcohol with 10 or more and 15 or less carbons, and nonionic surfactants in which, on average, 2 or more and 5 or less moles of an ethylene oxide is added to a methyl ester of a fatty acid with 10 or more and 14 or less carbons.

The number of the hydroxy group of the polyhydric alcohol constituting component (a3) is preferably 3 or more and preferably 6 or less. Examples of the polyhydric alcohol constituting component (a3) include glycerin, diglycerin, trimethylolpropane, pentaerythritol, sorbitan and the like. In addition, the fatty acid constituting component (a3) has preferably 10 or more, and 18 or less and preferably 14 or less carbons. Specific examples of component (a3) include glyceryl mono- or di-laurate, glyceryl mono- or di-stearate, trimethylolpropane mono- or di-laurate, pentaerythritol mono- or di-laurate and sorbitan mono-laurate.

The alkanoyl group constituting component (a4) has preferably 10 or more, and preferably 16 or less and more preferably 14 or less carbons. The alkanol group (—ROH: R is an alkylene group with 2 or 3 carbons) has preferably 2 carbons. In addition, in the case of the alkylene oxide adduct, the average number of added moles is preferably 1 or more and 3 or less. The alkylene oxide is preferably an alkylene oxide with 2 carbons and/or an alkylene oxide with 3 carbons, i.e., an ethylene oxide and/or a propylene oxide, and more preferably an ethylene oxide.

The hydrocarbon group constituting component (a5) has preferably 10 or more, and preferably 16 or less and more preferably 14 or less carbons. The hydrocarbon group of component (a4) is preferably an alkyl group. The alkylene oxide is preferably an alkylene oxide with 2 carbons and/or an alkylene oxide with 3 carbons, i.e., an ethylene oxide and/or a propylene oxide, and more preferably an ethylene oxide. In addition, the average number of added moles of the alkylene oxide is preferably 1 or more and 4 or less.

Component (a) is preferably component (a1).

The liquid detergent composition for tableware and/or kitchen hard articles of the present invention preferably contains one or more nonionic surfactants selected from components (a1) to (a5) as component (a). Further, it is preferable that the liquid detergent composition for tableware and/or kitchen hard articles of the present invention contain one or more nonionic surfactants selected from components (a1) to (a5) as component (a) and a proportion of the one or more nonionic surfactants selected from components (a1) to (a5) in component (a) be 30 mass % or more, further 60 mass % or more and further 90 mass % or more. The upper limit value of this proportion is 100 mass % or less and may be 100 mass %.

[Component (b)]

Component (b) is a glycoside having a hydrocarbon group with 8 or more and 18 or less carbons and a glycoside group with an average degree of condensation of 0.5 or more and 3 or less.

Examples of the hydrocarbon group of component (b) include an alkyl group and an alkenyl group, and an alkyl group is preferable. The hydrocarbon group of component (b), preferably an alkyl group, has preferably 10 or more, and preferably 16 or less and further preferably 14 or less carbons. The average degree of condensation of the glycoside group of component (b) is preferably 0.7 or more and more preferably 1 or more, and preferably 2.5 or less and more preferably 2 or less.

Specific examples of component (b) include an alkyl glycoside or polyalkyl glycoside in which a linear or branched alcohol having, on average, 8 or more and 14 or less carbons and, on average, 0.8 or more and 2.0 or less moles of a glucose are condensed.

[Component (c)]

Component (c) is an organic solvent with a logPow of 0 or more and 1.5 or less.

An organic solvent with 2 or more carbons and further 3 or more carbons, and 10 or less carbons and further 8 or less carbons is preferable as component (c). In addition, an organic solvent selected from monohydric alcohols, polyhydric alcohols (glycol and the like) and glycol ethers is preferable as component (c).

The logPow of component (c) is preferably 0.2 or more and more preferably 0.3 or more, and preferably 1.2 or less and more preferably 1 or less.

In the present invention, the logPow value is the coefficient indicating the affinity of an organic compound for water and 1-octanol. The 1-octanol/water partition coefficient P is, in a distribution equilibrium caused when a trace amount of compound is dissolved as a solute in the solvents of the two liquid phases of 1-octanol and water, a ratio between the equilibrium concentrations of the compound in the respective solvents, and generally represented in the form of logPow, which is the logarithm thereof to base 10. The logPow value has been reported for many compounds and so many values are listed in databases available from Daylight Chemical Information Systems, Inc. (Daylight CIS) and the like that can be referred to. If there is no measured logPow value, it can be calculated by a program "CLOGP" available from Daylight CIS, or the like. This program outputs a value of "calculated logPow (ClogPow)" calculated by Hansch, Leo fragment approach together with a measured logPow value if any.

The fragment approach is based on chemical structures of compounds, where the number of atoms and chemical bonding types are taken into account (cf. A. Leo, *Comprehensive Medicinal Chemistry*, Vol. 4, C. Hansch, P. G. Sammens, J. B. Taylor and C. A. Ramsden, Eds., p. 295, Pergamon Press, 1990). This ClogPow value can be used instead of a measured logPow value at the selection of a compound. In the present invention, a measured logPow value is used if any, or otherwise the ClogPow value calculated by the program CLOGP v4.01 is used.

Examples of component (c) can include: (c-1) a monohydric alcohol with 1 or more and 3 or less carbons; (c-2) a polyhydric alcohol with 2 or more and 4 or less carbons; (c-3) a di or trialkyleneglycol having an alkyleneglycol unit with 2 or more and 4 or less carbons; and (c-4) a monoalkyl (methyl, ethyl, propyl or butyl), monophenyl or monobenzyl ether of a mono, di, tri or tetraalkyleneglycol having an alkyleneglycol unit with 2 or more and 4 or less carbons.

Specific examples of (c-1) include ethanol and isopropyl alcohol; those of (c-2) include isoprene glycol; and those of (c-4) include propylene glycol monoethyl ether, diethylene glycol monobutyl ether (also referred to as butyldiglycol and the like), triethylene glycol monobutyl ether (also referred to as butyltriglycol and the like), phenoxyethanol, phenoxytriethyleneglycol and phenoxyisopropanol. Among them, an organic solvent selected from ethanol, dipropylene glycol monobutyl ether, diethylene glycol monobutyl ether, triethylene glycol monobutyl ether, phenoxyethanol and phenoxyisopropanol is preferable.

From the viewpoint of further enhancing the washing effect for the liquid oil stain derived from food, component (c) having an alkoxy group is preferable. Further, from the viewpoint of further enhancing the washing effect for the liquid oil stain derived from food, the liquid detergent composition for tableware and/or kitchen hard articles of the present invention contains, as component (c), preferably one or more selected from the aforementioned (c-4), preferably one or more selected from diethylene glycol monobutyl ether and triethylene glycol monobutyl ether, and more preferably diethylene glycol monobutyl ether.

[Composition, Optional Components and Others]

While the working mechanism of the present invention is unknown, the present inventers think as follows: component (a) is a W/O type surfactant having a property of emulsifying/dispersing water in an oily component; on the other hand, component (b) is an O/W type surfactant; when such a W/O type surfactant as component (a) is brought into contact with a liquid oil adhered to a hydrophobic surface such as plastic, component (a) permeates the liquid oil while emulsifying water, thereby causing a remarkable decrease in interface energy between the hydrophobic surface and the liquid oil, and thus, the liquid oil can be readily removed from the hydrophobic interface by the O/W type surfactant, or component (b); as the permeability of component (a) and the detergency of component (b) independent of an external force can be further enhanced particularly when the composition of the present invention is brought into contact with the liquid oil in a foamy state, the present invention adopts, as component (b), a surfactant rich in foamability; further, component (c) having a particular logPow is considered to have a function of augmenting the effect of enhancing the permeability of component (a) through the liquid oil; it is considered that, with these functions, the present invention can improve the detergency against the liquid oil stain adhered to the tableware and the like and easily wash the liquid oil stain without applying an external force.

The liquid detergent composition for tableware and/or kitchen hard articles of the present invention contains component (a) in an amount of preferably 0.5 mass % or more, more preferably 1 mass % or more and further preferably 2 mass % or more, and preferably 10 mass % or less, more preferably 8 mass % or less and further preferably 6 mass % or less from the viewpoint of the detergency against the liquid oil stain.

The liquid detergent composition for tableware and/or kitchen hard articles of the present invention contains component (b) in an amount of preferably 0.25 mass % or more, more preferably 1 mass % or more and further preferably 2 mass % or more, and preferably 10 mass % or less, more preferably 8 mass % or less and further preferably 6 mass % or less from the viewpoint of the foamability.

The liquid detergent composition for tableware and/or kitchen hard articles of the present invention contains component (c) in an amount of preferably 0.5 mass % or more, more preferably 1 mass % or more and further preferably 4 mass % or more, and preferably 30 mass % or less, more preferably 20 mass % or less and further preferably 15 mass % or less from the viewpoint of the detergency against the liquid oil stain.

In the liquid detergent composition for tableware and/or kitchen hard articles of the present invention, a proportion of component (a) in all surfactants is 30 mass % or more, preferably 30.0 mass % or more, more preferably 35 mass % or more and further preferably 40 mass % or more, and 95 mass % or less, preferably 90 mass % or less and more preferably 80 mass % or less from the viewpoint of the detergency against the liquid oil stain.

In the liquid detergent composition for tableware and/or kitchen hard articles of the present invention, the total proportion of components (a) and (b) in all surfactants is preferably 50 mass % or more, more preferably 60 mass % or more, further preferably 70 mass % or more and furthermore preferably 80 mass % or more, and preferably 100 mass % or less and may be 100 mass % from the viewpoint of the detergency against the liquid oil stain.

In the liquid detergent composition for tableware and/or kitchen hard articles of the present invention, a mass ratio of the content of component (c) to the content of component (a), (c)/(a), is 2 or more and 8 or less from the viewpoint of the detergency against the liquid oil stain. The mass ratio of (c)/(a) is preferably 2.0 or more, and 8 or less, preferably 5 or less, more preferably 4 or less and further preferably 3 or less.

In the liquid detergent composition for tableware and/or kitchen hard articles of the present invention, a mass ratio of the content of component (a) to the content of component (b), (a)/(b), is preferably 0.5 or more and 10 or less from the viewpoint of the detergency against the liquid oil stain and a foamability immediately after the formation of foam. The mass ratio of (a)/(b) is preferably 0.5 or more, and more preferably 8 or less and further preferably 5 or less.

In the liquid detergent composition for tableware and/or kitchen hard articles of the present invention, the total content of surfactants is preferably 0.5 mass % or more, more preferably 1 mass % or more and further preferably 3 mass % or more, and preferably 20 mass % or less, more preferably 15 mass % or less and further preferably 10 mass % or less from the viewpoint of the foamability. This total content of surfactants is calculated based on the total amount of components (a) and (b) as well as any other surfactants.

While the present invention can contain surfactants other than components (a) and (b), they need to be used in a range not impairing the effects of the present invention. Since an anionic surfactant [hereinafter, referred to as component (d)] risks affecting the permeability of component (a) through the liquid oil, if the composition contains it, the content therein is preferably 5 mass % or less, more preferably 4 mass % or less, further preferably 3 mass % or less, furthermore preferably 2 mass % or less and furthermore preferably 1 mass % or less.

For the purpose of enhancing detergency against a solid fat, the liquid detergent composition for tableware and/or kitchen hard articles of the present invention can contain (d1) a sulfosuccinate ester-type surfactant [hereinafter, referred to as component (d1)] as component (d). Examples of component (d1) include a sulfosuccinate ester represented by the following general formula (d1) or a salt thereof:

$$R^{1d}-(OA^1)_x-OCOCH_2\underset{\underset{SO_3M^1}{|}}{C}HCOO-(A^2O)_y-R^{2d}, \quad (d1)$$

wherein each of $R^{1d}$ and $R^{2d}$ is independently a linear or branched hydrocarbon group with 5 or more and 18 or less carbons; each of $A^1$ and $A^2$ is independently an alkylene group with 2 or more and 4 or less carbons; x and y are the average numbers of added moles and each independently 0 or more and 6 or less; and $M^1$ is a hydrogen atom or a cationic ion.

In the general formula (d1), each of $R^{1d}$ and $R^{2d}$ is independently a linear or branched hydrocarbon group with 5 or more, preferably 6 or more, more preferably 7 or more and further preferably 8 or more carbons, and 18 or less, preferably 16 or less and further preferably 14 or less carbons. Each of $R^{1d}$ and $R^{2d}$ is independently preferably a branched alkyl group.

In the general formula (d1), each of $A^1$ and $A^2$ is independently an alkylene group with 2 or more carbons and 4 or less and preferably 3 or less carbons.

In the general formula (d1), x and y are the average numbers of added moles and each independently 0 or more, and 6 or less, preferably 4 or less, more preferably 2 or less and further preferably 0 from the viewpoint of the detergency.

In addition, x+y is preferably 0 or more, and preferably 12 or less, more preferably 6 or less, further preferably 3 or less and furthermore preferably 0 from the viewpoint of the detergency.

In the general formula (d1), each of $R^{1d}$ and $R^{2d}$ is preferably an alkyl group selected from a 2-ethylhexyl group, a sec-octyl group, an isopentyl group, an isononyl group and an isodecyl group, further preferably an alkyl group selected from a sec-octyl group, an isodecyl group and a 2-ethylhexyl group, and further preferably a 2-ethylhexyl group.

In the general formula (d1), $M^1$ is a hydrogen atom or a cationic ion. Examples of the cationic ion include inorganic cationic ions such as a sodium ion, an ammonium ion, a potassium ion, a magnesium ion and the like, and organic cationic ions such as a monoethanolammonium ion, a diethanolammonium ion, a triethanolammonium ion, a morpholinium ion and the like. The cationic ion is preferably an inorganic cationic ion selected from a sodium ion, an ammonium ion, a potassium ion and a magnesium ion.

In component (d1), a compound having the same $R^{1d}$ and $R^{2d}$ can be produced referring to, as its preparation method, by way of example and without any particular limitation, a method described in U.S. Pat. No. 2,028,091, and in addition, an asymmetrical compound having different $R^{1d}$ and $R^{2d}$ can be produced referring to, for example, JP-A S58-24555. When commercially available compounds are used, PELEX OT-P (a compound in which both $R^{1d}$ and $R^{2d}$ are a 2-ethylhexyl group) manufactured by Kao Corporation, LuensitA-BO (a compound in which both $R^{1d}$ and $R^{2d}$ are a 2-ethylhexyl group) manufactured by BASF SE, Airrol CT-1L (a compound in which both $R^{1d}$ and $R^{2d}$ are a 2-ethylhexyl group) manufactured by Toho Chemical Industry Co., Ltd. and the like can be used. As a raw material of component (d1), an alcohol having a certain number of carbons to which an alkylene oxide is added can also be used.

Component (d1) is a preferable component from the viewpoint of the detergency against the liquid oil stain, and in addition, against a stain including a solid fat (hereinafter, sometimes also referred to as a solid fat stain). When the liquid detergent composition for tableware and/or kitchen hard articles of the present invention contains component (d1), the composition contains component (d1) in an amount of preferably 0.01 mass % or more, more preferably 0.05 mass % or more, further preferably 0.1 mass % or more and furthermore preferably 0.5 mass % or more, and preferably 5 mass % or less, more preferably 3 mass % or less and further preferably 2 mass % or less from the viewpoint of the detergency against the liquid oil stain and the solid fat stain.

Examples of components other than component (d1) in component (d) can include a polyoxyethylene alkyl ether sulfate ester salt, an alkyl sulfate ester salt, an alkylbenzene sulfonate and the like.

The liquid detergent composition for tableware and/or kitchen hard articles of the present invention can further contain (e) a metal chelating agent [hereinafter, referred to as component (e)]. Examples of component (e) include citric acid, ethylenediaminetetraacetic acid, methylglycinediacetic acid, L-glutamate diacetate, and salts, for example, sodium salts and the like, of them. When the liquid detergent composition for tableware and/or kitchen hard articles of the present invention contains component (e), the composition contains component (e) in an amount of preferably 0.1 mass % or more, more preferably 0.5 mass % or more and further preferably 1 mass % or more, and preferably 15 mass % or less, more preferably 10 mass % or less and further preferably 5 mass % or less from the viewpoint of the detergency against the liquid oil stain.

It is preferable that the liquid detergent composition for tableware and/or kitchen hard articles of the present invention be brought into contact with the objects in a state of foam. Thus, if a component impairing the foamability of the composition is used, attention needs to be paid. While the liquid detergent composition for tableware and/or kitchen hard articles of the present invention can also contain a solvent other than component (c), since a hydrocarbon-based solvent such as a paraffin or terpene hydrocarbon or the like [hereinafter, referred to as component (f)] reduces the foamability of the composition of the present invention, it is desirable that the content thereof be restricted. In the composition of the present invention, a mass ratio of the content of component (f) to the sum of the contents of components (a) and (b), component (f)/[component (a)+component (b)], is preferably 0.5 or less, more preferably 0.3 or less and further preferably 0.1 or less. Here, examples of the hydrocarbon-based solvent of component (f) can include a normal paraffin with 10 or more and 20 or less carbons, an isoparaffin with 10 or more and 20 or less carbons and the like as the paraffin-based solvent, and can include limonene, terpene, pinene and the like as the terpenoid-based solvent. In the present invention, it is preferable that the paraffin-based solvent and the terpenoid-based solvent be used as component (f) and the content thereof be at the aforementioned mass ratio.

While the liquid detergent composition for tableware and/or kitchen hard articles of the present invention can also contain the solvents other than component (c), it is preferable that the content of (f1) an organic solvent with a logPow of more than 1.5 [hereinafter, referred to as component (f1)] be smaller from the same viewpoint as the one mentioned above in component (f). For example, in the liquid detergent composition for tableware and/or kitchen hard articles of the present invention, a mass ratio of the content of component (f1) to the content of component (c), (f1)/(c), may be 0.5 or less, further 0.3 or less, further 0.1 or less and further 0. Component (f) usually has a logPow of more than 1.5 and therefore is also component (f1).

The liquid detergent composition for tableware and/or kitchen hard articles of the present invention can contain components such as an antigelling agent, a thickener such as polyacrylic acid or the like, a fragrance, a dye, a pigment, a bactericide, an antiseptic, a pH adjuster and the like.

The liquid detergent composition for tableware and/or kitchen hard articles of the present invention contains water. That is, the balance other than components (a) through (c) and the optional components mentioned above is water. The liquid detergent composition for tableware and/or kitchen hard articles of the present invention contains water in an amount of preferably 30 mass % or more, more preferably 50 mass % or more, more preferably 60 mass % or more, further preferably 70 mass % or more, furthermore preferably 80 mass % or more and furthermore preferably 90 mass % or more, and preferably 99.5 mass % or less and more preferably 99 mass % or less from the viewpoint of adjusting the composition to have a suitable viscosity and allowing the effects of the present invention to be fully exhibited. It is preferable that ion exchange water, sterilized ion exchange water or the like be used as the water.

A pH at 25° C. of the liquid detergent composition for tableware and/or kitchen hard articles of the present invention is preferably 2 or more, more preferably 4 or more and more preferably 5 or more, and preferably 10 or less, more preferably 9 or less and further preferably 8 or less from the viewpoint of mildness to hands.

In the present invention, the viscosity of the composition is an important factor for the purpose of obtaining high detergency against the liquid oil stain without having to apply an external force. When the viscosity of the composition is too high, the composition is adhered to the stain but is hard to permeate therethrough, and thus, the stain cannot be fully washed out if an external force is not applied. In the present invention, when the viscosity of the composition is in a moderate range, the permeation of components (a), (b) and (c) through the stain is promoted and high detergency can therefore be exhibited without applying an external force. Since the detergency is more prominently exhibited when the composition of the present invention is brought into contact with the stain in a state of foam, the foamy application is a preferable aspect.

A viscosity at 20° C. of the liquid detergent composition for tableware and/or kitchen hard articles of the present invention is 20 mPa·s or less, preferably 15 mPa·s or less, more preferably 10 mPa·s or less, further preferably 7 mPa·s or less and furthermore preferably 5 mPa·s or less. The lower limit value of this viscosity can be preferably 0.5 mPa·s or more and more preferably 1 mPa·s or more. The viscosity can be adjusted by a solvent, a hydrotrope agent or the like. Here, the viscosity was measured by the following method.

[Method for Measuring Viscosity]

A B-type viscometer model BM manufactured by TOKIMEC INC. equipped with a rotor of a rotor number No. 1 is prepared. A beaker for measuring the viscosity is filled with the liquid detergent composition to be measured and the temperature is sufficiently adjusted in a thermostatic water bath at 20° C. A value of 60 seconds later measured by placing the beaker containing the composition on the viscometer and setting the number of revolutions of the rotor for 60 r/min shall be the viscosity of the composition.

It is preferable that the liquid detergent composition for tableware and/or kitchen hard articles of the present invention be applied to tableware or kitchen hard articles in foam. The foam obtained from the composition of the present invention has a specific foam volume of preferably 30 ml/g or less, more preferably 20 ml/g or less, further preferably 10 ml/g or less and furthermore preferably 7 ml/g or less from the viewpoint of the detergency. The lower limit value of the specific foam volume is preferably 1 ml/g or more and further 2 ml/g or more. From that viewpoint, it is also preferable that the foam have a specific foam volume in that range after a lapse of a certain period of time from the formation, for example, 1 minute after the formation.

In addition, the foam obtained from the composition of the present invention is preferably 10 ml/g or more, more preferably 15 ml/g or more and further preferably 20 ml/g or more for the convenience of being capable of widely covering the objects or from a psychological viewpoint of provoking an expectation of detergency. The upper limit value of the specific foam volume is preferably 100 ml/g or less. From that viewpoint, it is preferable that the foam have a specific foam volume in that range immediately after the formation.

Here, the specific foam volume can be calculated by the following formula:

$$\text{Specific foam volume (mL/g)} = \text{volume of foam (mL)}/\text{mass of foam (g)}.$$

While it is favorable and suitable that the foam immediately after brought into contact with the tableware and/or kitchen hard articles, i.e., the foam immediately after discharged be rich in foaming from an aesthetic viewpoint or in view of provoking an expectation of detergency and the like, it is preferable from the viewpoint of the detergency that the bulk of the foam become moderately smaller with the lapse of time for a better movability of component (a) to the liquid oil stain. In the present invention, when the specific foam volume (mL/g) becomes preferably 10 or less and more preferably 7 or less 1 minute after discharge, the movability of component (a) to the liquid oil is favorable and the washing effect is improved. In order to form such foam, the effect of component (c) is important, and it is preferable that the relative content with respect to component (b) which is a foamable surfactant be adjusted. In the present invention, from such a viewpoint, a mass ratio of the content of component (c) to the content of component (b), (c)/(b), is preferably 0.5 or more, more preferably 1 or more, further preferably 1.2 or more and furthermore preferably 1.5 or more, and preferably 7 or less and more preferably 5 or less.

<Method for Washing Tableware and/or Kitchen Hard Articles>

The method for washing tableware and/or kitchen hard articles of the present invention is a washing method including bringing the liquid detergent composition for tableware and/or kitchen hard articles of the present invention into contact, without diluting and in a state of foam, with tableware and/or kitchen hard articles to which the stain containing a liquid oil derived from food, for example, a composite stain of the liquid oil and a solid fat, is adhered. This method is suitable for washing a portion not accessible by hands or tools or an inaccessible small portion.

When the liquid detergent composition for tableware and/or kitchen hard articles of the present invention is brought into contact with the stain containing a liquid oil derived from food, the liquid oil is split into fragments and detached from the objects (the tableware and/or kitchen hard articles) so as to float up thereon. Thus, in the washing method of the present invention, even if an external force such as washing by scrubbing is not applied, the liquid oil can be readily washed out by, for example, after leaving for a predetermined time, rinsing the objects with water.

In the washing method of the present invention, it is preferable that the liquid detergent composition be brought into contact, without diluting and in a state of foam, with the tableware and/or kitchen hard articles to which the stain containing a liquid oil derived from food is adhered, and rinsed without scrubbing.

In the washing method of the present invention, it is preferable that the liquid detergent composition be brought into contact, without diluting and in a foamy state, with tableware and/or kitchen hard articles to which, for example, an oil stain including a liquid oil is adhered, and washed without applying an external force such as a mechanical force.

In the washing method of the present invention, it is preferable that the liquid detergent composition be brought into contact, without diluting and in a foamy state, with the tableware and/or kitchen hard articles to which, for example, the oil stain including a liquid oil is adhered, and left and washed without applying an external force such as a mechanical force.

Washing tableware and/or kitchen hard articles without applying an external force such as a mechanical force is, for example, not performing the operation of intentionally applying an external force for washing to the objects, other than bringing into contact with the composition. For example, allowing the composition that is brought into contact with the tableware and/or kitchen hard articles to naturally flow down along the surfaces thereof, allowing a vibration that is not intended for washing to be transmitted to the tableware and/or kitchen hard articles, or the like can be understood as washing tableware and/or kitchen hard articles without applying an external force such as a mechanical force.

Bringing the liquid detergent composition into contact, without diluting, with the tableware and/or kitchen hard articles to which the stain containing a liquid oil derived from food is adhered is not bringing, after intentionally diluting with water or the like, the detergent composition into contact with the tableware and/or kitchen hard articles to which the stain containing a liquid oil derived from food is adhered. For example, a case where the liquid detergent composition is brought into contact with the tableware and/or kitchen hard articles to which water drops and the like are adhered, or a case where water drops are adhered to the tableware and/or kitchen hard articles after bringing the liquid detergent composition into contact with the tableware and/or kitchen hard articles can be understood as bringing the liquid detergent composition into contact, without diluting, with the tableware and/or kitchen hard articles to which the stain containing a liquid oil derived from food is adhered.

After leaving, the hard articles are rinsed with water. At the time of rinsing, an external force (a physical force) may be applied by hands or the like or they may simply be rinsed with running water.

Examples of the washing method of the present invention include a washing method including bringing the liquid detergent composition into contact, in a foamy state, with the tableware and/or kitchen hard articles to which the stain containing a liquid oil derived from food is adhered, and leaving as it is without applying an external force such as a mechanical force, or without performing any of washing with a flexible material, washing with running water and washing with ultrasonic waves. That is, examples of the washing method of the present invention include a washing method including bringing the liquid detergent composition into contact, in a foamy state, with the tableware and/or kitchen hard articles to which the stain containing a liquid oil derived from food is adhered, and leaving as it is without applying an external force such as a mechanical force, or without using any of a friction force due to a flexible material such as a sponge or the like, a force of running water such as a shower within an automatic dishwasher and ultrasonic vibrations.

The stain containing a liquid oil derived from food may be a composite stain including the liquid oil and a solid fat. For example, the solid fat exists as a solid at normal temperature (for example, 20° C.). When the liquid detergent composition is brought into contact with the composite stain, its form may be a state of the liquid oil and the solid fat existing in a mixed manner. A stain to which the present invention is directed may be an oil and fat stain including a large amount of liquid oil.

In the present invention, it is preferable that an undiluted solution of the liquid detergent composition be adhered, as it is, i.e., without changing its composition, and in a foamy state, to the tableware and/or kitchen hard articles to which the stain containing a liquid oil derived from food is adhered. For example, it is preferable that the liquid detergent composition be brought into contact, without allowing it to be adhered to a sponge absorbing water or the like, and in a foamy state, to the tableware and/or kitchen hard articles to which the stain containing a liquid oil derived from food is adhered. After brought into contact with the tableware and/or kitchen hard articles, the liquid detergent composition may change its composition. That is, after brought into contact with the tableware and/or kitchen hard articles, the liquid detergent composition may be subjected to dilution or concentration of its composition.

In addition, it may be such that: a concentrated composition including components (a), (b) and (c) of the present invention has been prepared; the concentrated composition is diluted with water to prepare the liquid detergent composition used for the present invention; and this liquid detergent composition is brought into contact with the tableware and/or kitchen hard articles without diluting and in a state of foam. That is, the method for washing tableware and/or kitchen hard articles may include: diluting the concentrated composition containing components (a), (b) and (c) of the present invention with water, thereby preparing the liquid detergent composition used for the present invention; bringing the liquid detergent composition into contact, without diluting, with the tableware and/or kitchen hard articles to which the stain containing a liquid oil derived from food is adhered; and washing without applying an external force such as a mechanical force.

In the washing method of the present invention, after brought into contact without diluting and in a state of foam with the tableware and/or kitchen hard articles to which the stain containing a liquid oil derived from food is adhered, the liquid detergent composition is left, preferably without applying (giving) an external force. That is, examples of the method include a washing method including bringing into contact without using a flexible material such as a sponge or the like, fingers, or the like, and leaving as it is without applying an external force such as a mechanical force. After leaving, rinsing with water is usually performed. At the time of rinsing, an external force (a physical force) may be applied by hands or the like or they may simply be rinsed with running water.

Examples of the washing method of the present invention include a method for washing tableware and/or kitchen hard articles, including bringing the liquid detergent composition for tableware and/or kitchen hard articles of the present invention into contact, in a state of foam with a specific foam volume of 1 ml/g or more and preferably 2 ml/g or more, and 100 ml/g or less, with the tableware and/or kitchen hard articles to which the stain containing a liquid oil derived from food is adhered. The specific foam volume can be calculated by the following formula:

Specific foam volume (mL/g)=volume of foam (mL)/mass of foam (g).

In the washing method of the present invention, it is favorable that the liquid detergent composition be brought into contact, in a state of having a specific foam volume (mL/g) of preferably 10 or more, more preferably 15 or more and further preferably 20 or more, with the tableware and/or kitchen hard articles to which the stain containing a liquid oil derived from food is adhered, and that the foam have a specific foam volume (mL/g) of preferably 30 or less, more preferably 20 or less, further preferably 10 or less and furthermore preferably 7 or less 1 minute after brought into contact with the stain.

While it is favorable and suitable that the foam immediately after brought into contact with the tableware and/or kitchen hard articles, i.e., the foam immediately after discharged be rich in foaming from an aesthetic viewpoint or in view of provoking an expectation of detergency and the like, it is preferable from the viewpoint of the detergency that the bulk of the foam become moderately smaller with the lapse of time for a better movability of component (a) to the liquid oil stain. In the present invention, when the specific foam volume (mL/g) becomes preferably 10 or less and more preferably 7 or less 1 minute after discharge, the movability of component (a) to the liquid oil is favorable and the washing effect is improved. In order to form such foam, the effect of component (c) is important, and it is preferable that the relative content with respect to component (b) which is a foamable surfactant be adjusted. In the present invention, from such a viewpoint, a mass ratio of component (c)/component (b) is preferably 0.5 or more, more preferably 1 or more, further preferably 1.2 or more, furthermore preferably 1.5 or more and furthermore preferably 2 or more, and preferably 7 or less and more preferably 5 or less.

In the washing method of the present invention, it is preferable that the liquid detergent composition be brought into contact, and further applied or sprayed in a state of foam, at a proportion of preferably 0.1 g or more, more preferably 0.3 g or more and further preferably 0.4 g or more, and preferably 5 g or less, more preferably 3 g or less and further preferably 2 g or less relative to an area of 100 $cm^2$ of the targeted tableware and/or kitchen hard articles.

In the washing method of the present invention, after brought into contact with tableware and/or kitchen hard articles, the liquid detergent composition is left for preferably 10 seconds or more, more preferably 20 seconds or more, further preferably 30 seconds or more, furthermore preferably 40 seconds or more, furthermore preferably 50 seconds or more and furthermore preferably 1 minute or more from the viewpoint of enhancing the detergency, and preferably 60 minutes or less, more preferably 30 minutes or less, further preferably 20 minutes or less, furthermore preferably 10 minutes or less and furthermore preferably 5 minutes or less from the same viewpoint. In this case, a point of time when the composition in a state of foam is initially brought into contact with the tableware and/or kitchen hard articles may be the start of the leaving.

Note that examples of the temperature at the time of leaving include room temperature, for example, 10° C. or more and 30° C. or less.

In the washing method of the present invention, it is preferable that, using a spray means, the liquid detergent composition be brought into contact, in a state of foam, with the tableware and/or kitchen hard articles to which the stain containing a liquid oil derived from food is adhered. It is preferable that a specific foam volume of the foam discharged from the spray means be in the aforementioned range, and it is more preferable that specific foam volumes immediately thereafter and 1 minute later be in the aforementioned range. It is more preferable that, using a detergent article made by filling the liquid detergent composition used for the present invention into a container provided with a sprayer having a foam forming mechanism, the liquid detergent composition be brought into contact, in a state of foam, with the tableware and/or kitchen hard articles to which the stain containing a liquid oil derived from food is adhered. The present invention provides a detergent article in a spray container made by filling the liquid detergent composition used for the present invention into a container provided with a sprayer having a foam forming mechanism.

Examples of the aforementioned container provided with a sprayer include manual spray devices that do not use a propellant, such as a trigger-type spray container, a pump-type spray container and the like, and an aerosol and the like that use a propellant. The aforementioned container provided with a sprayer is preferably a trigger-type spray capable of spraying or applying the contents in a foamy state and more preferably a trigger-type spray provided with a mechanism for foaming foam (foam forming mechanism).

When the trigger-type spray provided with a foam forming mechanism is used in the aforementioned detergent article in a spray container, a spray preferably having a spin element and a liquid passing plate made by arranging some rod-like projections in a circular space with a diameter of 4 to 8 mm is suitable. Here, the spin element is a mechanism that gives a spin to the flow of a liquid material through the spin element and finally ejects it from a nozzle, and as to the detailed structure, reference can be made to JP-A H8-332422, FIG. 4(b) of JP-A H8-108102, FIG. 1 of JP-A 2002-68265, or the like.

When the trigger-type spray provided with the foam forming mechanism is used, the aforementioned detergent article in a spray container sprays the composition in an amount of preferably 0.5 mL or more and more preferably 1 mL or more, and preferably 30 mL or less, more preferably 15 mL or less and further preferably 5 mL or less per operation.

The liquid passing plate, the other member of the foam forming mechanism is made by arranging preferably 3 to 8 rod-like projections in a circular space with a diameter of 5 to 7 mm, and the rod-like projections are favorably shaped like a rectangular preferably with a width of 0.8 to 1.2 mm and a length of 2 to 4 mm when the passing plate is viewed in a plan view. In addition, an area occupied by the rod-like projections relative to the space excluding the rod-like projections is preferably 30 area % or more and more preferably 40 area % or more, and preferably 90 area % or less, more preferably 80 area % or less and further preferably 70 area % or less. By arranging such a liquid passing plate, a property of the foam to adhere to and remain on a vertical surface becomes better.

As a container of the aforementioned detergent article in a spray container, containers commonly used can be used. For example, it is obtained from polyethylene, polypropylene or polyethylene terephthalate as a raw material and can be manufactured by blow molding and the like. The container may have different thicknesses in the bottom surface and the side surfaces and they are preferably 0.01 to 2 mm, and the capacity of the container is preferably 100 to 1000 mL. An amount of the liquid detergent composition filled into the container is desirably 200 to 500 mL from a handing viewpoint. In addition, the liquid is filled so that there remains a reasonable gap.

An Object to be washed by the washing method of the present invention is tableware and/or kitchen hard articles, and preferably tableware.

The kitchen hard articles are articles used in and around a kitchen, and specifically are (1) places for storing food, tableware and cooking utensils, such as a refrigerator, a cupboard and the like,
(2) places for cooking food, such as a sink drain pipe, a cooking table, a range hood, a sink, a gas range, a microwave oven and the like, and
(3) floors, walls and the like around the places for storing or the places for cooking. In the present invention, they are referred to as "kitchen hard articles" for convenience.

In addition, specific examples of the tableware include members or utensils that make contact with food materials, like:

(i) so-called tableware such as a dish, a bowl and the like:
(ii) storage containers such as Tupperware®, a bottle and the like:
(iii) cooking utensils such as a kitchen knife and a chopping board, a pot, a frying pan, a fish broiler grill and the like: and
(iv) electric kitchen appliances such as a food processor, a mixer and the like. In the present invention, they are referred to as "tableware" for convenience.

In addition, it is preferable that the washing method of the present invention be directed to an article selected from the tableware, the storage containers, the cooking utensils and the electric kitchen appliances, and further, it is more preferable that it be directed to an article selected from a dish, a bowl, Tupperware®, a bottle, a kitchen knife, a chopping board, a pot, a frying pan, a fish broiler grill, food processor and a mixer.

Examples of materials of the tableware and/or kitchen hard articles to which the washing method of the present invention is directed include, plastics (including a silicone resin and the like), metals, ceramics, woods, and combinations thereof. In addition, the washing method of the present invention is capable of effectively washing out the stain containing a liquid oil derived from food adhered to these tableware and or kitchen hard articles.

As mentioned earlier, while the liquid oil adhered to a hydrophobic material such as plastic or the like is a hard-to-remove stain, the present invention also exhibits an excellent washing effect against the liquid oil adhered to the tableware and/or kitchen hard articles made of plastic. The present invention is suitable as a method for washing tableware and/or kitchen hard articles made of plastic. Examples of the plastic include polyolefins such as polypropylene, polyethylene and the like, polymethacrylate, polycarbonate, ABS resins, polyethylene terephthalate and the like.

In the washing method of the present invention, the liquid detergent composition used for the present invention is brought into contact, without diluting and in a state of foam, directly with the tableware and/or kitchen hard articles. Then, they only have to be left in the state where the composition is brought into contact, and thus, a task of applying an external force such as scrubbing-washing by a flexible material such as a sponge or the like is not necessarily required at the time of washing.

Thus, the washing method of the present invention can also be applied to the following articles which are hard to wash with the flexible material such as a sponge or the like:

(1) articles inconvenient to wash by hand, such as food processing equipment, a refrigerator, pipes and parts of a cupboard and the like and a sink drain pipe, a water bottle, a tumbler, a kettle, a pot, and the like;
(2) articles having a hard surface over which the stain containing a liquid oil derived from food is extensively spread, such as: places for storing food, tableware and cooking utensils, places for cooking food such as a cooking table, a range hood, a sink, a gas range, a microwave oven and the like; the vicinity of a kitchen such as floors, walls and the like around such places, and the like;
(3) articles involving some risk when washed by hand, such as a kitchen knife, a peeler, a grater, a slicer, blades of a juicer, blades of a food processor, and the like; and
(4) articles provided with a portion of a complicated form. Note that, in the present invention, after washing the tableware and/or kitchen hard articles without applying an external force such as a mechanical force, scrubbing-washing may be performed as necessary.

Further, in the washing method of the present invention, as the liquid detergent composition is applied to the tableware and/or kitchen hard articles in a foamy state and left as it is, the composition can remain on the tableware and/or kitchen hard articles for a long duration.

The washing method of the present invention includes a step of rinsing with water the tableware and/or kitchen hard articles with which the liquid detergent composition is brought into contact, and preferably a step of rinsing with water, after leaving, the tableware and/or kitchen hard articles with which the liquid detergent composition is brought into contact.

<Aspects of the Present Invention>

Hereinafter, aspects of the present invention are illustrated. To these aspects, the matters mentioned in the liquid detergent composition for tableware and/or kitchen hard articles and the method for washing hard articles of the present invention can appropriately be applied.

<1>

A liquid detergent composition for tableware and/or kitchen hard articles containing:

(a) a nonionic surfactant with an HLB of 10.5 or less (provided that (b) is excluded) [hereinafter, referred to as component (a)]; (b) a glycoside having a hydrocarbon group with 8 or more and 18 or less carbons and a glycoside group with an average degree of condensation of 0.5 or more and 3 or less [hereinafter, referred to as component (b)]; and (c) an organic solvent with a logPow of 0 or more and 1.5 or less [hereinafter, referred to as component (c)], wherein the content of component (a) in all surfactants is 30 mass % or more and 95 mass % or less, a mass ratio of the content of component (c) to the content of component (a), (c)/(a), is 2 or more and 8 or less, and a viscosity at 20° C. is 20 mPa·s or less.

<2>

The liquid detergent composition for tableware and/or kitchen hard articles according to <1>, wherein a mass ratio of the content of component (a) to the content of component (b), (a)/(b), is 0.5 or more, and 10 or less, preferably 8 or less and more preferably 5 or less.

<3>

The liquid detergent composition for tableware and/or kitchen hard articles according to <1> or <2>, wherein the HLB of component (a) is preferably 3 or more, more preferably 4 or more and further preferably 5 or more, and preferably 10 or less, more preferably 9.5 or less and further preferably 9 or less.

<4>

The liquid detergent composition for tableware and/or kitchen hard articles according to any of <1> to <3>, wherein component (a) is one or more nonionic surfactants selected from:

(a1) alkyl glyceryl ethers with an HLB of 10.5 or less in which the number of carbons of the alkyl group is 5 or more and 10 or less [hereinafter, referred to as component (a1)];

(a2) polyoxyalkylene-type nonionic surfactants with an HLB of 10.5 or less, which are nonionic surfactants in which, on average, 1 or more and 5 or less moles of an alkylene oxide with 2 or 3 carbons is added to an aliphatic alcohol with 8 or more and 18 or less carbons or to a lower alcohol ester of a fatty acid with 8 or more and 18 or less carbons (the number of carbons of the lower alcohol is 1 or more and 3 or less) [hereinafter, referred to as component (a2)];

(a3) polyhydric alcohol ester-type nonionic surfactants consisting of an ester with an HLB of 10.5 or less, wherein the ester is of a polyhydric alcohol having 2 or more and 10 or less hydroxy groups and a fatty acid with 8 or more and 18 or less carbons [hereinafter, referred to as component (a3)];

(a4) alkanol amide-type nonionic surfactants with an HLB of 10.5 or less, which are a mono- or di-alkanol amide having an alkanoyl group with 8 or more and 18 or less carbons (the number of carbons of the alkanol group is 2 or 3), or an alkylene oxide adduct thereof (the number of carbons of the alkylene oxide is 2 or 3 and the average number of added moles thereof is more than 0 and 4 or less) [hereinafter, referred to as component (a4)]; and (a5) nonionic surfactants with an HLB of 10.5 or less, which are an adduct of an alkylene oxide with 2 or 3 carbons to an amine having a hydrocarbon group with 8 or more and 18 or less carbons [hereinafter, referred to as component (a5)].

<5>

The liquid detergent composition for tableware and/or kitchen hard articles according to <4>, wherein component (a) is component (a1).

<6>

The liquid detergent composition for tableware and/or kitchen hard articles according to <4>, wherein component (a) is component (a2).

<7>

The liquid detergent composition for tableware and/or kitchen hard articles according to <4>, wherein component (a) is component (a3).

<8>

The liquid detergent composition for tableware and/or kitchen hard articles according to <4>, wherein component (a) is component (a4).

<9>

The liquid detergent composition for tableware and/or kitchen hard articles according to <4>, wherein component (a) is component (a5).

<10>

The liquid detergent composition for tableware and/or kitchen hard articles according to any of <4> to <9>, containing one or more nonionic surfactants selected from components (a1) to (a5) as component (a), wherein a proportion of the one or more nonionic surfactants selected from components (a1) to (a5) in component (a) is 30 mass % or more, further 60 mass % or more and further 90 mass % or more, and 100 mass % or less, or 100 mass %.

<11>

The liquid detergent composition for tableware and/or kitchen hard articles according to any of <1> to <10>, wherein the hydrocarbon group of component (b) is an alkyl group or an alkenyl group, and further an alkyl group.

<12>

The liquid detergent composition for tableware and/or kitchen hard articles according to any of <1> to <11>, wherein the hydrocarbon group of component (b) has preferably 10 or more, and preferably 16 or less and further preferably 14 or less carbons.

<13>

The liquid detergent composition for tableware and/or kitchen hard articles according to any of <1> to <12>, wherein the average degree of condensation of the glycoside group of component (b) is preferably 0.7 or more and more preferably 1 or more, and preferably 2.5 or less and more preferably 2 or less.

<14>

The liquid detergent composition for tableware and/or kitchen hard articles according to any of <1> to <13>, wherein component (b) is an alkyl glycoside or polyalkyl glycoside in which a linear or branched alcohol having 8 or more and 14 or less carbons on average, and on average, 0.8 or more and 2.0 or less moles of a glucose are condensed.

<15>

The liquid detergent composition for tableware and/or kitchen hard articles according to any of <1> to <14>, wherein component (c) is an organic solvent with 2 or more and further 3 or more, and 10 or less and further 8 or less carbons.

<16>

The liquid detergent composition for tableware and/or kitchen hard articles according to any of <1> to <15>, wherein component (c) is an organic solvent selected from monohydric alcohols, polyhydric alcohols and glycol ethers.

<17>

The liquid detergent composition for tableware and/or kitchen hard articles according to any of <1> to <16>, wherein component (c) is an organic solvent selected from monohydric alcohols, polyhydric alcohols and glycol ethers, with 2 or more and further 3 or more, and 10 or less and further 8 or less carbons.

<18>

The liquid detergent composition for tableware and/or kitchen hard articles according to any of <1> to <17>, wherein the logPow of component (c) is preferably 0.2 or more and more preferably 0.3 or more, and preferably 1.2 or less and more preferably 1 or less.

<19>

The liquid detergent composition for tableware and/or kitchen hard articles according to any of <1> to <18>, wherein component (c) is an organic solvent having an alkoxy group.

<20>

The liquid detergent composition for tableware and/or kitchen hard articles according to any of <1> to <19>, wherein component (c) is an organic solvent selected from: (c-1) monohydric alcohols with 1 or more and 3 or less carbons; (c-2) polyhydric alcohols with 2 or more and 4 or less carbons; (c-3) di or trialkyleneglycols having an alkyleneglycol unit with 2 or more and 4 or less carbons; and (c-4) monoalkyl (methyl, ethyl, propyl or butyl), monophenyl or monobenzyl ethers of a mono, di, tri or tetraalkyleneglycol having an alkyleneglycol unit with 2 or more and 4 or less carbons.

<21>

The liquid detergent composition for tableware and/or kitchen hard articles according to <20>, containing one or more selected from (c-4) as component (c), further containing one or more selected from diethylene glycol monobutyl ether and triethylene glycol monobutyl ether as component (c), and further containing diethylene glycol monobutyl ether as component (c).

<22>

The liquid detergent composition for tableware and/or kitchen hard articles according to any of <1> to <21>, containing component (a) in an amount of preferably 0.5 mass % or more, more preferably 1 mass % or more and further preferably 2 mass % or more, and preferably 10 mass % or less, more preferably 8 mass % or less and further preferably 6 mass % or less.

<23>

The liquid detergent composition for tableware and/or kitchen hard articles according to any of <1> to <22>, containing component (b) in an amount of preferably 0.25 mass % or more, more preferably 1 mass % or more and further preferably 2 mass % or more, and preferably 10 mass % or less, more preferably 8 mass % or less and further preferably 6 mass % or less.

<24>

The liquid detergent composition for tableware and/or kitchen hard articles according to any of <1> to <23>, containing component (c) in an amount of preferably 0.5 mass % or more, more preferably 1 mass % or more and further preferably 4 mass % or more, and preferably 30 mass % or less, more preferably 20 mass % or less and further preferably 15 mass % or less.

<25>

The liquid detergent composition for tableware and/or kitchen hard articles according to any of <1> to <24>, wherein a proportion of component (a) in all surfactants is 30 mass % or more, preferably 30.0 mass % or more, more preferably 35 mass % or more and further preferably 40 mass % or more, and 95 mass % or less, preferably 90 mass % or less and more preferably 80 mass % or less.

<26>

The liquid detergent composition for tableware and/or kitchen hard articles according to any of <1> to <25>, wherein the mass ratio of (c)/(a) is preferably 2.0 or more, and preferably 5 or less, more preferably 4 or less and further preferably 3 or less.

<27>

The liquid detergent composition for tableware and/or kitchen hard articles according to any of <1> to <26>, wherein a mass ratio of the content of component (c) to the content of component (b), (c)/(b), is preferably 0.5 or more, more preferably 1 or more, further preferably 1.2 or more and furthermore preferably 1.5 or more, and preferably 7 or less and more preferably 5 or less.

<28>

The liquid detergent composition for tableware and/or kitchen hard articles according to any of <1> to <27>, wherein the content of an anionic surfactant [hereinafter, referred to as component (d)] in the composition is preferably 5 mass % or less, more preferably 4 mass % or less, further preferably 3 mass % or less, furthermore preferably 2 mass % or less and furthermore preferably 1 mass % or less.

<29>

The liquid detergent composition for tableware and/or kitchen hard articles according to <27> or <28>, containing, as component (d), (d1) a sulfosuccinate ester-type surfactant [hereinafter, referred to as component (d1)] and further containing a sulfosuccinate ester represented by the following general formula (d1) or a salt thereof:

$$R^{1d}-(OA^1)_x-OCOCH_2\underset{\underset{SO_3M^1}{|}}{CH}COO-(A^2O)_y-R^{2d} \quad \text{(d1)}$$

wherein each of $R^{1d}$ and $R^{2d}$ is independently a linear or branched hydrocarbon group with 5 or more and 18 or less carbons; each of $A^1$ and $A^2$ is independently an alkylene group with 2 or more and 4 or less carbons; x and y are the average numbers of added moles and each of them is independently 0 or more and 6 or less; and $M^1$ is a hydrogen atom or a cationic ion.

<30>

The liquid detergent composition for tableware and/or kitchen hard articles according to <29>, containing component (d1) in an amount of preferably 0.01 mass % or more, more preferably 0.05 mass % or more, further preferably 0.1 mass % or more and furthermore preferably 0.5 mass % or more, and preferably 5 mass % or less, more preferably 3 mass % or less and further preferably 2 mass % or less.

<31>

The liquid detergent composition for tableware and/or kitchen hard articles according to any of <1> to <30>, wherein a total proportion of components (a) and (b) in all surfactants is preferably 50 mass % or more, more preferably 60 mass % or more, further preferably 70 mass % or more and furthermore preferably 80 mass % or more, and preferably 100 mass % or less, or 100 mass %.

<32>

The liquid detergent composition for tableware and/or kitchen hard articles according to any of <1> to <31>, wherein the total content of surfactants is preferably 0.5 mass % or more, more preferably 1 mass % or more and further preferably 3 mass % or more, and preferably 20 mass % or less, more preferably 15 mass % or less and further preferably 10 mass % or less.

<33>

The liquid detergent composition for tableware and/or kitchen hard articles according to any of <1> to <32>, further containing (e) a metal chelating agent [hereinafter, referred to as component (e)].

<34>

The liquid detergent composition for tableware and/or kitchen hard articles according to <33>, containing component (e) in an amount of preferably 0.1 mass % or more, more preferably 0.5 mass % or more and further preferably 1 mass % or more, and preferably 15 mass % or less, more preferably 10 mass % or less and further preferably 5 mass % or less.

<35>

The liquid detergent composition for tableware and/or kitchen hard articles according to any of <1> to <34>, wherein a mass ratio of the content of (f) a hydrocarbon-based solvent [hereinafter, referred to as component (f)] to the sum of the contents of components (a) and (b), component (f)/[components (a)+(b)], is preferably 0.5 or less, more preferably 0.3 or less and further preferably 0.1 or less.

<36>

The liquid detergent composition for tableware and/or kitchen hard articles according to <35>, wherein component (f) is a solvent selected from paraffin-based solvents and terpenoid-based solvents, and further a hydrocarbon-based solvent selected from a normal paraffin with 10 or more and 20 or less carbons, an isoparaffin with 10 or more and 20 or less carbons, limonene, terpene and pinene.

<37>

The liquid detergent composition for tableware and/or kitchen hard articles according to any of <1> to <36>, wherein a mass ratio of the content of (f1) an organic solvent with a logPow of more than 1.5 [hereinafter, referred to as component (f1)] to the content of component (c), (f1)/(c), is 0.5 or less, further 0.3 or less, further 0.1 or less and further 0.

<38>

The liquid detergent composition for tableware and/or kitchen hard articles according to any of <1> to <37>, containing water in an amount of preferably 30 mass % or more, more preferably 50 mass % or more, more preferably 60 mass % or more, further preferably 70 mass % or more, furthermore preferably 80 mass % or more and furthermore preferably 90 mass % or more, and preferably 99.5 mass % or less and more preferably 99 mass % or less.

<39>

The liquid detergent composition for tableware and/or kitchen hard articles according to any of <1> to <38>, wherein a pH at 25° C. is preferably 2 or more, more preferably 4 or more and more preferably 5 or more, and preferably 10 or less, more preferably 9 or less and further preferably 8 or less.

<40>

The liquid detergent composition for tableware and/or kitchen hard articles according to any of <1> to <39>, wherein a viscosity at 20° C. is preferably 15 mPa·s or less, more preferably 10 mPa·s or less, further preferably 7 mPa·s or less and furthermore preferably 5 mPa·s or less.

<41>

The liquid detergent composition for tableware and/or kitchen hard articles according to any of <1> to <40>, wherein a viscosity at 20° C. is preferably 0.5 mPa·s or more and more preferably 1 mPa·s or more.

<42>

The liquid detergent composition for tableware and/or kitchen hard articles according to any of <1> to <41>, wherein the composition is applied to tableware and/or kitchen hard articles in foam and further in foam having a specific foam volume in the range of preferably 30 ml/g or less, more preferably 20 ml/g or less, further preferably 10 ml/g or less and furthermore preferably 7 ml/g or less, and preferably 1 ml/g or more and more preferably 2 ml/g or more.

<43>

The liquid detergent composition for tableware and/or kitchen hard articles according to <42>, wherein the foam has a specific foam volume in the range of preferably 30 ml/g or less, more preferably 20 ml/g or less, further preferably 10 ml/g or less and furthermore preferably 7 ml/g or less, and preferably 1 ml/g or more and more preferably 2 ml/g or more 1 minute after the formation.

<44>

The liquid detergent composition for tableware and/or kitchen hard articles according to any of <1> to <43>, wherein the composition is applied to tableware and/or kitchen hard articles in foam and further in foam having a specific foam volume in the range of preferably 10 ml/g or more, more preferably 15 ml/g or more and further preferably 20 ml/g or more, and preferably 100 ml/g or less.

<45>

The liquid detergent composition for tableware and/or kitchen hard articles according to <44>, wherein the foam has a specific foam volume of preferably 10 ml/g or less and furthermore preferably 7 ml/g or less 1 minute after the formation.

<46>

A method for washing tableware and/or kitchen hard articles including bringing the liquid detergent composition for tableware and/or kitchen hard articles according to any of <1> to <45> into contact, in a state of foam, with tableware and/or kitchen hard articles to which a stain containing a liquid oil derived from food is adhered.

<47>

The method for washing tableware and/or kitchen hard articles according to <46>, wherein said liquid detergent composition for tableware and/or kitchen hard articles is brought into contact, in a state of foam with a specific foam volume of 1 ml/g or more and preferably 2 ml/g or more, and 100 ml/g or less, with tableware and/or kitchen hard articles to which a stain containing a liquid oil derived from food is adhered.

<48>

The method for washing tableware and/or kitchen hard articles according to <46> or <47>, including, after bringing into contact with said tableware and/or kitchen hard articles in said state of foam, leaving said detergent composition without applying an external force.

<49>

The method for washing tableware and/or kitchen hard articles according to any of <46> to <48>, including, after bringing into contact with said tableware and/or kitchen hard articles in said state of foam, leaving said detergent composition without applying an external force, and thereafter rinsing said tableware and/or kitchen hard articles with water.

<50>

The method for washing tableware and/or kitchen hard articles according to any of <46> to <49>, wherein the tableware and/or kitchen hard articles are made of plastic.

<51>

The method for washing tableware and/or kitchen hard articles according to any of <46> to <50>, wherein said liquid detergent composition is brought into contact, in a state of having a specific foam volume (mL/g) of preferably 10 or more, more preferably 15 or more and further preferably 20 or more, with tableware and/or kitchen hard articles to which a stain containing a liquid oil derived from food is adhered, and 1 minute after the contact with the stain, the specific foam volume (mL/g) of the foam becomes preferably 30 or less, more preferably 20 or less, further preferably 10 or less and furthermore preferably 7 or less.

<52>

The method for washing tableware and/or kitchen hard articles according to any of <46> to <51>, wherein said liquid detergent composition is brought into contact, and further applied or sprayed in a state of foam, at a proportion of preferably 0.1 g or more, more preferably 0.3 g or more and further preferably 0.4 g or more, and preferably 5 g or less, more preferably 3 g or less and further preferably 2 g or less relative to an area of 100 $cm^2$ of the targeted tableware and/or kitchen hard articles.

<53>

The method for washing tableware and/or kitchen hard articles according to any of <46> to <52>, including, after bringing into contact with tableware and/or kitchen hard articles, leaving said liquid detergent composition for preferably 10 seconds or more, more preferably 20 seconds or more, further preferably 30 seconds or more, furthermore preferably 40 seconds or more, furthermore preferably 50 seconds or more and furthermore preferably 1 minute or more, and preferably 60 minutes or less, more preferably 30 minutes or less, further preferably 20 minutes or less, furthermore preferably 10 minutes or less and furthermore preferably 5 minutes or less.

EXAMPLES

Using the following formulation components, liquid detergent compositions shown in Tables 1 through 4 were prepared and evaluations of the following items were performed on them. The results are shown in Tables 1 through 4. Note that the liquid detergent compositions shown in Tables 1 through 4 were adjusted to have pH 7 (20° C.) by citric acid and a 48% NaOH aqueous solution. In addition, mass % of formulation components in Tables 1 through 4 are all numerical values based on the active components. Further, the content of "all surfactants" in the tables is the total content of components (a), (b) and (d). Moreover, the compositions of Tables 1 through 4 are liquid detergent compositions for tableware and/or kitchen hard articles.

Formulation Components a-1: 2-ethylhexyl glyceryl ether (HLB: 7.4, the HLB is a value determined by the aforementioned experimental method), PENETOL GE-EH, Kao Corporation a-2: polyoxyethylene alkyl ether, the number of carbons of the alkyl group: 13, the average number of added moles of the ethylene oxide: 3 (HLB: 8.6), SOFTANOL 33, NIPPON SHOKUBAI CO., LTD.

a-3: sorbitan monolaurate (HLB: 8.6), EMASOL L-10V, Kao Corporation a-4: glyceryl monolaurate (HLB: 5.3), LKT Laboratories, Inc.

a-5: palm kernel oil fatty acid diethanolamide (HLB: 5.5, the HLB is a value determined by the aforementioned experimental method), AMINON PK-025, Kao Corporation a-6: N-lauryl-N,N-diethanolamine (HLB: 6.3, the HLB is a value determined by the aforementioned experimental method), AMIET 102, Kao Corporation a-7: polyoxyethylene lauryl amine, the average number of added moles of the oxyethylene: 5 (HLB: 9.8, the HLB is a value determined by the aforementioned experimental method), AMIET 105, Kao Corporation Component (b)

b-1: alkyl glycoside (an alkyl polyglucoside of C8 through C16, the degree of condensation of the glucose is 1 to 2, Plantacare 2000 UP, BASF SE)

Component (c)

c-1: diethylene glycol monobutyl ether (logPow: 0.66)

c-2: ethanol (logPow: 0.07)

c-3: triethylene glycol monobutyl ether (logPow: 0.92)

Component (c) (a Comparative Compound of Component (c))

c'-1: ethylene glycol (logPow: −1.4)

c'-2: propylene glycol (logPow: −1.1)

Component (d) (Other Surfactants)

d-1: sulfosuccinate ester (di-2-ethyl hexyl sulfosuccinate sodium salt, Airrol CT-1K, Toho Chemical Industry Co., Ltd.)

d-2: sodium polyoxyethylene alkyl ether sulfate, the number of carbons of the alkyl group: 12 to 16, the average number of added moles of the ethylene oxide: 4.0 (the product name "ES-4K," manufactured by Kao Corporation)

Component (f1)

f-1: dodecane (logPow: 5.51)

(1) Viscosity

A B-type viscometer model BM manufactured by TOKIMEC INC. equipped with a rotor of a rotor number No. 1 was prepared. A liquid detergent composition of the tables was filled into a beaker for measuring the viscosity, and the temperature was fully adjusted in a thermostatic water bath at 20° C. A value of 60 seconds later, which was measured by placing the beaker containing the composition on the viscometer and setting the number of revolutions of the rotor for 60 r/min, was used as the viscosity of the composition.

(2) Specific Foam Volume

The liquid detergent composition was filled into a trigger-type spray container (Cucute clear foam spray, manufactured by Kao Corporation) and sprayed into a 200 mL measuring cylinder (an inner diameter of 40 mm) for 3 to 10 times. A mass of the 200 mL measuring cylinder after the spraying was measured with a 4-digit balance, and a difference with a mass of the measuring cylinder before the spraying was taken as (a) a foam applying amount (g). Foam volumes (mL) within the measuring cylinder immediately after the discharge and 1 minute after the discharge were visually read. The foam volume (mL) immediately after the discharge was taken as (b) and the foam volume (mL) 1 minute after the discharge was taken as (b'). The specific foam volumes were calculated by the following formula. The larger the specific foam volume is, the more excellent the foam discharge performance is.

$$\text{Specific foam volume (mL/g)}=[(b) \text{ or } (b')]/(a)$$

(3) Formulation Stability

The liquid detergent composition after the preparation was visually observed and evaluated with the following criteria:

○: left to stand at 25° C. after the preparation and the separation was not observed a day later, X: left to stand at 25° C. after the preparation and the separation was observed a day later.

(4) Evaluation of Detergency Against Liquid Oil Stain

The mass of a polypropylene test piece of 75 mm (width)×100 mm (length)×1 mm (thickness) was measured with a 4-digit balance (x). One side of the polypropylene test piece was evenly coated with rapeseed oil in an applying amount of 0.08 to 0.12 g to prepare a stained piece. The mass of the stained piece was measured with a 4-digit balance (y).

The liquid detergent composition was filled into the trigger-type spray container (Cucute clear foam spray, manufactured by Kao Corporation) and sprayed to the stained piece for 5 times. The composition was discharged in a foamy state. The discharge amount of the composition was about 3 g in total.

The stained piece was kept in contact with the discharged foam for 1 minute and thereafter rinsed under running water for 15 seconds. At that time, the entire portion to which the stain was adhered in the stained piece was brought into contact with the foam. Under this condition, the liquid detergent composition of the examples was brought into contact in a state of foam with a specific foam volume of 10.9 to 55.4 mL/g. Note that, as to the specific foam volume used herein, the specific foam volume (immediately thereafter) measured by the aforementioned method was taken as the specific foam volume of the foam brought into contact. In addition, as to the conditions of the rinsing under running water, the temperature of tap water was 25° C., the flow rate was about 4 L/min, and the diameter of an opening of a faucet was about 15 mm. The stained piece was held to form an angle of 45° relative to tap water dropped to the stained piece located perpendicularly underneath the opening by 5 cm; while the angle was kept constant, running water was received with an upper portion of the stained piece to which the stain was not adhered; and, with tap water running on the stained piece, the entire one side as the portion to be washed was rinsed. After the rinsing was finished, the stained piece was dried, and thereafter, the mass was measured with a 4-digit balance (z). A washing rate was determined by the following formula. For the washing rate, a larger numerical value is preferable.

$$\text{Washing rate (\%)}=\{(y)-(z)\}/\{(y)-(x)\}\times 100$$

(5) Evaluation of Detergency Against Solid Fat Stain

A mixture of beef tallow and rapeseed oil at a mass ratio of 9:1 was prepared and used as a model stain (a model stain of a stain including a solid fat, the same applies hereinafter). The mass of a polypropylene test piece of 30 mm (width)×80 mm (length)×1 mm (thickness) was measured with a 4-digit balance (x). Both sides of the polypropylene test piece were, up to a height of 50 mm from the lower end, evenly coated with the model stain in an amount of 0.02 to 0.03 g for the both sides in total to prepare a stained piece. The mass of the stained piece was measured with a 4-digit balance (y).

The liquid detergent composition in an amount of 50 g was put into a 50 mL container (a cylinder with an inner diameter of 35 mm×a height of 68 mm), and a single stained piece was then leaned against the inner side of the container and brought into contact with the composition. At that time, the entire portion to which the stain was adhered in the stained piece was immersed in the composition within the container.

After immersing the stained piece in the liquid detergent composition within the container for 1 minute, the stained piece was taken out and rinsed under running water for 1 minute. At that time, as to the conditions of the rinsing under running water, the temperature of tap water was 25° C., the flow rate was about 4 L/min, and the diameter of an opening of a faucet was about 15 mm. The stained piece was held to form an angle of 45° relative to tap water dropped to the stained piece located perpendicularly underneath the opening by 5 cm; while the angle was kept constant, running water was received with an upper portion of the stained piece to which the stain was not adhered; and, with tap water running on the stained piece, the entire one side as the portion to be washed was rinsed. At that time, the back and front was changed every 10 seconds and rinsed alternately. After the rinsing was finished, the stained piece was dried, and thereafter, the mass was measured with a 4-digit balance (z). A washing rate was determined by the following formula:

$$\text{Washing rate (\%)}=\{(y)-(z)\}/\{(y)-(x)\}\times 100.$$

TABLE 1

| | | | Example | | | Comparative example | | Example | | Comparative example | |
|---|---|---|---|---|---|---|---|---|---|---|---|
| | | | 1 | 2 | 3 | 1 | 2 | 4 | 5 | 3 | 4 |
| Liquid detergent composition | Formulation (a) component (mass %) | a-1 (HLB: 7.4) | 3 | 4.5 | 5.5 | 0.25 | 6 | 3 | 3 | 3 | 3 |
| | | a-2 (HLB: 8.6) | | | | | | | | | |
| | | a-3 (HLB: 8.6) | | | | | | | | | |
| | | a-4 (HLB: 5.3) | | | | | | | | | |
| | | a-5 (HLB: 5.5) | | | | | | | | | |
| | | a-6 (HLB: 6.3) | | | | | | | | | |
| | | a-7 (HLB: 9.8) | | | | | | | | | |

TABLE 1-continued

| | | | Example | | | Comparative example | | Example | | Comparative example | |
|---|---|---|---|---|---|---|---|---|---|---|---|
| | | | 1 | 2 | 3 | 1 | 2 | 4 | 5 | 3 | 4 |
| | (b) | b-1 | 3 | 1.5 | 0.5 | 5.75 | | 3 | 3 | 3 | 3 |
| | (c) | c-1 (logPow: 0.66) | 8 | 12 | 14.7 | 0.667 | 8 | 7 | 12 | 4 | 25 |
| | | c-2 (logPow: 0.07) | | | | | | | | | |
| | | c-3 (logPow: 0.92) | | | | | | | | | |
| | (c') | c'-1 (logPow: −1.4) | | | | | | | | | |
| | | c'-2 (logPow: −1.1) | | | | | | | | | |
| | (d) | d-1 | | | | | | | | | |
| | | d-2 | | | | | | | | | |
| | Ion exchange water | | Balance | Balance | Balance | Balance | Balance | Balance | Balance | Balance | Balance |
| | Total | | 100 | 100 | 100 | 100 | 100 | 100 | 100 | 100 | 100 |
| (c)/(a) (mass ratio) | | | 2.7 | 2.7 | 2.7 | 2.7 | 1.3 | 2.3 | 4.0 | 1.3 | 8.3 |
| (a)/(b) (mass ratio) | | | 1.0 | 3.0 | 11 | 0.043 | — | 1.0 | 1.0 | 1.0 | 1.0 |
| (c)/[(a) + (b)] (mass ratio) | | | 1.3 | 2.0 | 2.5 | 0.11 | 1.3 | 1.2 | 2.0 | 0.67 | 4.2 |
| Amount of all surfactants (mass %) | | | 6.0 | 6.0 | 6.0 | 6.0 | 6.0 | 6.0 | 6.0 | 6.0 | 6.0 |
| Proportion of component (a) in all surfactants (mass %) | | | 50.0 | 75.0 | 91.7 | 4.17 | 100 | 50.0 | 50.0 | 50.0 | 50.0 |
| Proportion of components (a) and (b) in all surfactants (mass %) | | | 100.0 | 100.0 | 100.0 | 100.0 | 100.0 | 100.0 | 100.0 | 100.0 | 100.0 |
| pH (20° C.) | | | 7 | 7 | 7 | 7 | 7 | 7 | 7 | 7 | 7 |
| Viscosity (mPa · s/20° C.) | | | 2.43 | 2.65 | 2.9 | 1.8 | —※ | 2.67 | 2.4 | —※ | 3.7 |
| Specific foam volume | Immediately thereafter (ml/g) | | 55.4 | 24.6 | 10.9 | 47.7 | —※ | 47.1 | 45.6 | —※ | 21.1 |
| | 1 minute later (ml/g) | | 37.9 | 1.6 | 0.0 | 46.6 | —※ | 18.8 | 14.5 | —※ | 1.1 |
| Formulation stability | | | ○ | ○ | ○ | ○ | X | ○ | ○ | X | ○ |
| Washing rate for liquid oil stain (%) | | | 97.7 | 96.2 | 90.6 | 20.4 | —※ | 97.7 | 91.7 | —※ | 65.4 |

*separated at the time of formulation and therefore not evaluated (the same applies hereinafter).

TABLE 2

| | | | | Example | | | | | | |
|---|---|---|---|---|---|---|---|---|---|---|
| | | | | 6 | 7 | 8 | 9 | 10 | 11 | 12 |
| Liquid detergent composition | Formulation component (mass %) | (a) | a-1 (HLB: 7.4) | | | | | | | 3 |
| | | | a-2 (HLB: 8.6) | 3 | | | | | | |
| | | | a-3 (HLB: 8.6) | | 3 | | | | | |
| | | | a-4 (HLB: 5.3) | | | 3 | | | | |
| | | | a-5 (HLB: 5.5) | | | | 3 | | | |
| | | | a-6 (HLB: 6.3) | | | | | 3 | | |
| | | | a-7 (HLB: 9.8) | | | | | | 3 | |
| | | (b) | b-1 | 3 | 3 | 3 | 3 | 3 | 3 | 3 |
| | | (c) | c-1 (logPow: 0.66) | 8 | 8 | 8 | 8 | 8 | 8 | |
| | | | c-2 (logPow: 0.07) | | | | | | | 18 |
| | | | c-3 (logPow: 0.92) | | | | | | | |
| | | (c') | c'-1 (logPow: −1.4) | | | | | | | |
| | | | c'-2 (logPow: −1.1) | | | | | | | |
| | | (d) | d-1 | | | | | | | |
| | | | d-2 | | | | | | | |
| | | Ion exchange water | | Balance | Balance | Balance | Balance | Balance | Balance | Balance |
| | | Total | | 100 | 100 | 100 | 100 | 100 | 100 | 100 |
| | (c)/(a) (mass ratio) | | | 2.7 | 2.7 | 2.7 | 2.7 | 2.7 | 2.7 | 6.0 |
| | (a)/(b) (mass ratio) | | | 1.0 | 1.0 | 1.0 | 1.0 | 1.0 | 1.0 | 1.0 |
| | (c)/[(a) + (b)] (mass ratio) | | | 1.3 | 1.3 | 1.3 | 1.3 | 1.3 | 1.3 | 3.0 |
| | Amount of all surfactants (mass %) | | | 6.0 | 6.0 | 6.0 | 6.0 | 6.0 | 6.0 | 6.0 |

TABLE 2-continued

| | | | | | | | | |
|---|---|---|---|---|---|---|---|---|
| Proportion of component (a) in all surfactants (mass %) | | 50.0 | 50.0 | 50.0 | 50.0 | 50.0 | 50.0 | 50.0 |
| Proportion of components (a) and (b) in all surfactants (mass %) | | 100.0 | 100.0 | 100.0 | 100.0 | 100.0 | 100.0 | 100.0 |
| pH (20° C.) | | 7 | 7 | 7 | 7 | 7 | 7 | 7 |
| Viscosity (mPa · s/20° C.) | | 2.69 | 2.15 | 2.35 | 2.08 | 2.31 | 1.92 | 2.92 |
| Specific foam volume | Immediately thereafter (ml/g) | 20.6 | 26.2 | 18.1 | 48.8 | 36.4 | 40.2 | 20.9 |
| | 1 minute later (ml/g) | 16.8 | 22.5 | 16.9 | 47.8 | 34.3 | 40.2 | 7.6 |
| Formulation stability | | ○ | ○ | ○ | ○ | ○ | ○ | ○ |
| Washing rate for liquid oil stain (%) | | 88.9 | 75.7 | 88.3 | 54.2 | 58.7 | 49.6 | 90.1 |

| | | | | Comparative Example | Example | | | Comparative Example | Example |
|---|---|---|---|---|---|---|---|---|---|
| | | | | 13 | 5 | 14 | 15 | 6 | 16 |
| Liquid detergent composition | Formulation component (mass %) | (a) | a-1 (HLB: 7.4) | 3 | 3 | 2 | 2 | 1 | 2 |
| | | | a-2 (HLB: 8.6) | | | | | | |
| | | | a-3 (HLB: 8.6) | | | | | | |
| | | | a-4 (HLB: 5.3) | | | | | | |
| | | | a-5 (HLB: 5.5) | | | | | | |
| | | | a-6 (HLB: 6.3) | | | | | | |
| | | | a-7 (HLB: 9.8) | | | | | | |
| | | (b) | b-1 | 3 | 3 | 2 | 3 | 1 | 3 |
| | | (c) | c-1 (logPow: 0.66) | | | 5 | 5 | 2.67 | 6.5 |
| | | | c-2 (logPow: 0.07) | | | | | | |
| | | | c-3 (logPow: 0.92) | 7 | | | | | |
| | | (c') | c'-1 (logPow: −1.4) | | 10 | | | | |
| | | | c'-2 (logPow: −1.1) | | | | | | 5 |
| | | (d) | d-1 | | | | 1 | | 1 |
| | | | d-2 | | | 2 | | 4 | |
| | | Ion exchange water | | Balance | Balance | Balance | Balance | Balance | Balance |
| | | Total | | 100 | 100 | 100 | 100 | 100 | 100 |
| | (c)/(a) (mass ratio) | | | 2.3 | 3.3 | 2.5 | 2.5 | 2.7 | 3.3 |
| | (a)/(b) (mass ratio) | | | 1.0 | 1.0 | 1.0 | 0.67 | 1.0 | 0.67 |
| | (c)/[(a) + (b)] (mass ratio) | | | 1.2 | 1.7 | 1.3 | 1.0 | 1.3 | 1.3 |
| | Amount of all surfactants (mass %) | | | 6.0 | 6.0 | 6.0 | 6.0 | 6.0 | 6.0 |
| | Proportion of component (a) in all surfactants (mass %) | | | 50.0 | 50.0 | 33.3 | 33.3 | 16.7 | 33.3 |
| | Proportion of components (a) and (b) in all surfactants (mass %) | | | 100.0 | 100.0 | 66.7 | 83.3 | 33.3 | 83.3 |
| | pH (20° C.) | | | 7 | 7 | 7 | 7 | 7 | 7 |
| | Viscosity (mPa · s/20° C.) | | | 2.05 | —※ | 2.17 | 3.41 | 2.03 | 3.6 |
| Specific foam volume | | | Immediately thereafter (ml/g) | 50.0 | —※ | 48.5 | 46.8 | 18.9 | 25.7 |
| | | | 1 minute later (ml/g) | 43.0 | —※ | 2.0 | 3.0 | 18.9 | 21.3 |
| Formulation stability | | | | ○ | ○ | ○ | ○ | ○ | ○ |
| Washing rate for liquid oil stain (%) | | | | 96.2 | —※ | 77 | 100 | 35.2 | 98.3 |

TABLE 3

| | | | | Example | | | |
|---|---|---|---|---|---|---|---|
| | | | | 1 | 14 | 15 | 16 |
| Liquid detergent composition | Formulation component (mass %) | (a) | a-1 (HLB: 7.4) | 3 | 2 | 2 | 2 |
| | | (b) | b-1 | 3 | 2 | 3 | 3 |
| | | (c) | c-1 (logPow: 0.66) | 8 | 5 | 5 | 6.5 |
| | | (c') | c'-2 (logPow: −1.1) | | | | 5 |
| | | (d) | d-1 | | | 1 | 1 |
| | | | d-2 | | 2 | | |
| | | Ion exchange water | | Balance | Balance | Balance | Balance |
| | | Total | | 100 | 100 | 100 | 100 |
| | (c)/(a) (mass ratio) | | | 2.7 | 2.5 | 2.5 | 3.3 |
| | (a)/(b) (mass ratio) | | | 1.0 | 1.0 | 0.67 | 0.67 |
| | (c)/[(a) + (b)] (mass ratio) | | | 1.3 | 1.3 | 1.0 | 1.3 |
| | Amount of all surfactants (mass %) | | | 6.0 | 6.0 | 6.0 | 6.0 |
| | Proportion of component (a) in all surfactants (mass %) | | | 50.0 | 33.3 | 33.3 | 33.3 |
| | Proportion of components (a) and (b) in all surfactants (mass %) | | | 100.0 | 66.7 | 83.3 | 83.3 |
| | pH (20° C.) | | | 7 | 7 | 7 | 7 |
| | Viscosity (mPa · s/20° C.) | | | 2.43 | 2.17 | 3.41 | 3.6 |
| Specific foam volume | | Immediately thereafter (ml/g) | | 55.4 | 48.5 | 46.8 | 25.7 |
| | | 1 minute later (ml/g) | | 37.9 | 2.0 | 3.0 | 21.3 |
| Formulation stability | | | | ○ | ○ | ○ | ○ |
| Washing rate for liquid oil stain (%) | | | | 97.7 | 77 | 100 | 98.3 |
| Washing rate for solid fat stain (%) | | | | 49.3 | 20.8 | 71.3 | 64.2 |

TABLE 4

| | | | | Comparative example 7 | Example 17 |
|---|---|---|---|---|---|
| Liquid detergent composition | Formulation component (mass %) | (a) | a-1 (HLB: 7.4) | 3 | 3 |
| | | (b) | b-1 | 3 | 3 |
| | | (c) | c-1 (logPow: 0.66) | | 8 |
| | | (f1) | f-1 (logPow: 5.51) | 8 | 0.6 |
| | | Ion exchange water | | Balance | Balance |
| | | Total | | 100 | 100 |
| | (c)/(a) (mass ratio) | | | 0 | 2.7 |
| | (a)/(b) (mass ratio) | | | 1 | 1 |
| | (c)/[(a) + (b)] (mass ratio) | | | 0 | 1.3 |
| | Amount of all surfactants (mass %) | | | 6.0 | 6.0 |
| | Proportion of component (a) in all surfactants (mass %) | | | 50.0 | 50.0 |
| | Proportion of components (a) and (b) in all surfactants (mass %) | | | 100.0 | 100.0 |
| | pH (20° C.) | | | 7 | 7 |
| | Viscosity (mPa · s/20° C.) | | | 1.24 | 2.55 |
| Specific foam volume | | Immediately thereafter (ml/g) | | 0.0 | 11.1 |
| | | 1 minute later (ml/g) | | 0.0 | 3.7 |
| Formulation stability | | | | X | ○ |
| Washing rate for liquid oil stain (%) | | | | 41.2 | 84.8 |

In Table 5, formulation examples of the liquid detergent composition for tableware and/or kitchen hard articles of the present invention are shown. Components in Table 5 are the same as those of Tables 1 through 4. The viscosity (mPa·s/20° C.) of the liquid detergent compositions of Table 5 is 3 to 9.

TABLE 5

| | | | | Formulation example | | |
|---|---|---|---|---|---|---|
| | | | | 1 | 2 | 3 |
| Liquid detergent composition | Formulation component (mass %) | (a) | a-1 (HLB: 7.4) | 2 | 2 | 2 |
| | | (b) | b-1 | 3 | 3 | 3 |
| | | (c) | c-1 (logPow: 0.66) | 6.5 | 6.5 | 6.5 |
| | | (c') | c'-2 (logPow: −1.1) | 5 | 5 | 5 |
| | | (d) | d-1 | 1 | 1 | 1 |
| | | (e) | Citric acid | 1 | | 1 |
| | | | Methyl glycine diacetic acid | | 1 | |
| | | (f) | Limonene | | | 0.3 |
| | | Fragrance 1 of Table 6 | | 0.3 | | |
| | | Fragrance 2 of Table 6 | | | 0.3 | |
| | | Antiseptic | | 0.01 | 0.01 | |
| | | Ion exchange water | | Balance | Balance | Balance |
| | | Total | | 100 | 100 | 100 |
| | (c)/(a) (mass ratio) | | | 3.3 | 3.3 | 3.3 |
| | (a)/(b) (mass ratio) | | | 0.67 | 0.67 | 0.67 |
| | (c)/[(a) + (b)] (mass ratio) | | | 1.3 | 1.3 | 1.3 |
| | Amount of all surfactants (mass %) | | | 6.0 | 6.0 | 6.0 |
| | Proportion of component (a) in all surfactants (mass %) | | | 33.3 | 33.3 | 33.3 |
| | Proportion of components (a) and (b) in all surfactants (mass %) | | | 83.3 | 83.3 | 83.3 |
| | pH (20° C.) | | | 7 | 7 | 7 |

* Antiseptic: Proxel BDN (manufactured by Avecia Inc.)

TABLE 6

| | | Fragrance 1 | Fragrance 2 |
|---|---|---|---|
| Composition (parts by mass) | Limonene | 200 | |
| | Linalool | 100 | |
| | Geranylnitrile | 20 | |
| | Terpinolen | 50 | |
| | Citral | 30 | |
| | Geraniol | 100 | |
| | Phenoxyethanol | 100 | 500 |
| | Isoamyl acetate | 100 | 100 |
| | Citronellyl nitrile | 100 | 100 |
| | Methyl benzoate | 100 | |
| | Eugenol | 100 | 100 |
| | Benzyl alcohol | | 50 |
| | Cis-3-hexenol | | 100 |
| | Diethyl malonate | | 50 |
| | Total | 1000 | 1000 |

The invention claimed is:

1. A liquid detergent composition for tableware and/or kitchen hard articles comprising:

(a) a nonionic surfactant with an HLB of 10.5 or less (provided that (b) is excluded) [hereinafter, referred to as component (a)]; (b) a glycoside having a hydrocarbon group with 8 or more and 18 or less carbons and a glycoside group with an average degree of condensation of 0.5 or more and 3 or less [hereinafter, referred to as component (b)]; and (c) an organic solvent with a logPow of 0 or more and 1.5 or less [hereinafter, referred to as component (c)], wherein the content of the component (a) in all surfactants is 30 mass % or more and 95 mass % or less, a mass ratio of the content of the component (c) to the content of the component (a), (c)/(a), is 2 or more and 8 or less, and a viscosity at 20° C. is 20 mPa·s or less.

2. The liquid detergent composition for tableware and/or kitchen hard articles according to claim 1, wherein a mass ratio of the content of the component (a) to the content of the component (b), (a)/(b), is 0.5 or more and 10 or less.

3. The liquid detergent composition for tableware and/or kitchen hard articles according to claim 1, wherein the component (a) is an alkyl glyceryl ether with an HLB of 10.5 or less in which the number of carbons of the alkyl group is 5 or more and 10 or less.

4. The liquid detergent composition for tableware and/or kitchen hard articles according to claim 1, further comprising (d1) a sulfosuccinate ester-type surfactant.

5. The liquid detergent composition for tableware and/or kitchen hard articles according to claim 1, further comprising (e) a metal chelating agent.

6. A method for washing tableware and/or kitchen hard articles comprising bringing the liquid detergent composition for tableware and/or kitchen hard articles according to claim 1 into contact, in a state of foam, with tableware and/or kitchen hard articles to which a stain containing a liquid oil derived from food is adhered.

7. The method for washing tableware and/or kitchen hard articles according to claim 6, wherein said liquid detergent composition for tableware and/or kitchen hard articles is brought into contact, in a state of foam with a specific foam volume of 1 ml/g or more and 100 ml/g or less, with tableware and/or kitchen hard articles to which a stain containing a liquid oil derived from food is adhered.

8. The method for washing tableware and/or kitchen hard articles according to claim 6, comprising, after bringing into contact with said tableware and/or kitchen hard articles in said state of foam, leaving said detergent composition without applying an external force.

9. The method for washing tableware and/or kitchen hard articles according to claim 6, comprising, after bringing into contact with said tableware and/or kitchen hard articles in said state of foam, leaving said detergent composition without applying an external force, and thereafter rinsing said tableware and/or kitchen hard articles with water.

10. The method for washing tableware and/or kitchen hard articles according to claim 6, wherein the tableware and/or kitchen hard articles are made of plastic.

* * * * *